US005364411A

United States Patent [19]

Beretta

[11] Patent Number: 5,364,411

[45] Date of Patent: Nov. 15, 1994

[54] METHOD FOR SETTING DYES ON FABRICS, BY A TWO-STEP PROCESS, AND SYSTEM THEREFOR

[76] Inventor: Mario Beretta, Via G.P. Clerici, 2, 21040 Gerenzano (Varese), Italy

[21] Appl. No.: 144,051

[22] Filed: Oct. 27, 1993

[30] Foreign Application Priority Data

Apr. 5, 1993 [IT] Italy ..... MI93 A 00674

[51] Int. Cl.[5] ..... D06P 5/00

[52] U.S. Cl. ..... 8/476; 8/149.2

[58] Field of Search ..... 8/476, 469, 474, 149.2

[56] References Cited

U.S. PATENT DOCUMENTS 3,650,663 3/1972 Barwick et al. ..... 8/492

3,729,290 4/1973 Dillies ..... 8/149.2

5,077,039 12/1991 Baur et al. ..... 424/70

5,295,998 3/1994 Merritello et al. ..... 8/474

*Primary Examiner*—Arthur C. Prescott

*Attorney, Agent, or Firm*—Bucknam and Archer

[57] ABSTRACT

The present invention relates to a method for setting dyes on fabrics in general, by a two-step process, which comprises, after the printing and drying of a textile support, an impregnation of the support by an alkali solution.

The main feature of the invention is that, on the impregnated support, there is performed a vaporization, by arranging the textile support with free laps on supporting hollow rods inside a fabric-lap evaporizer.

5 Claims, 2 Drawing Sheets

METHOD FOR SETTING DYES ON FABRICS, BY A TWO-STEP PROCESS, AND SYSTEM THEREFOR

BACKGROUND OF THE INVENTION

The present invention relates to a method for setting dyes on fabrics in general, by the two-step process, as well as a system specifically designed for carrying out this method.

As is known, the so-called two-step process for setting reactive dyes on cotton or viscose comprises a first step, in which on a textile support there is printed and dryed a semi-dense mixture, comprising a dye and a thickening agent.

The second step of the process consists of causing the fabric to pass, after the printing and drying operation, through an alkali bath with an immediately subsequent vaporizing by using slightly super-heated steam, for a period of time which can vary from 12 to 15 seconds.

Between the alkali bath and vaporizer a pre-heating device is usually included, for example, of the infrared ray type.

This process is broadly used mainly for cotton or viscose fabrics, since it provides the possibility of printing and vaporizing the fabric in different days, and allows to obtain an optimum setting of the dyes, since the vaporizing operation is substantially of a wet-on-wet type.

Moreover, no polluting additional product is used, such as urea or accelerating substances, and the method involves a low consume of power for the vaporization, together with a small cost for the dyes, which is much smaller than that required for a single-step setting process.

In order to carry out the vaporization, there is at present used a vaporizer, comprising a tower or column, inside which there are held 8–12 meters of fabric.

In the column, the fabric is entrained to vertically rise, as controlled by a driven cylinder, arranged at the top of the column, and then the fabric is caused to downwardly move and exit the processing column.

The steam which is present inside the column or processing chamber has conventionally a temperature of 130° C., in order to assure a good setting of the dye.

The use of such a column derives from the fact that, during the processing operations, it is necessary that the printed side of the fabric does not rub on the cylinder since such a rubbing would damage the printed material.

This is a great limitation for the use of the above mentioned process, since the processed fabric will have, for each processing cycle, a length of only ten meters, since it would be not possible to make columns having excessively great heights.

Moreover, the use of a column or tower apparatus prevents the two step system from being applyed to knitted fabrics which would be susceptible to roll up on the fabric selvage during the up and down displacements through the vaporizing column.

SUMMARY OF THE INVENTION

Accordingly, the aim of the present invention is to overcome the above mentioned drawbacks, by providing a method for setting dyes on fabrics in general, by the two-step process, which affords the possibility of remarkably increasing the amount of fabric which can be introduced into the vaporizer, while improving the quality characteristics of the product.

Within the scope of the above mentioned aim, a main object of the present invention is to provide such a method in which, as the amount of fabric inside the vaporizer is increased, the processing time can be correspondingly increased, by using a smaller temperature steam, with a consequent increase of the moisture contents of the steam.

A further object of the present invention is to provide such a method which improves the setting of the dye, owing to a greater processing time, and which, moreover, provides very good set colours, and this owing to the possibility of using a damper steam.

A further object of the present invention is to provide such a method in which the two-step process can also be used for jersey knitted fabrics, which at present can not be processed in conventional column processing apparatus.

According to one aspect of the present invention, the above mentioned aim and objects, as well as yet other objects, which will become more apparent hereinafter, are achieved by a method for setting dyes on fabrics in general, by the two-step process, said method comprising, upon printing and drying a textile support, a step of impregnating said textile support with an alkali solution, characterized in that said method further comprises the step of vaporizing said impregnated textile support, by arranging said impregnated textile support with a free-lap arrangement on a plurality of supporting rods, inside a lap-processing vaporizer apparatus.

BRIEF DESCRIPTION OF THE DRAWINGS

Further characteristics and advantages of the present invention will become more apparent hereinafter from the following detailed disclosure of a preferred, though not exclusive, embodiment of a method for setting a dye on fabrics in general, by the two-step process, which is illustrated, by way of an indicative, but not limitative example, in the accompanying drawings, where.

DESCRIPTION OF THE PREFERRED EMBODIMENTS

Figure 1:
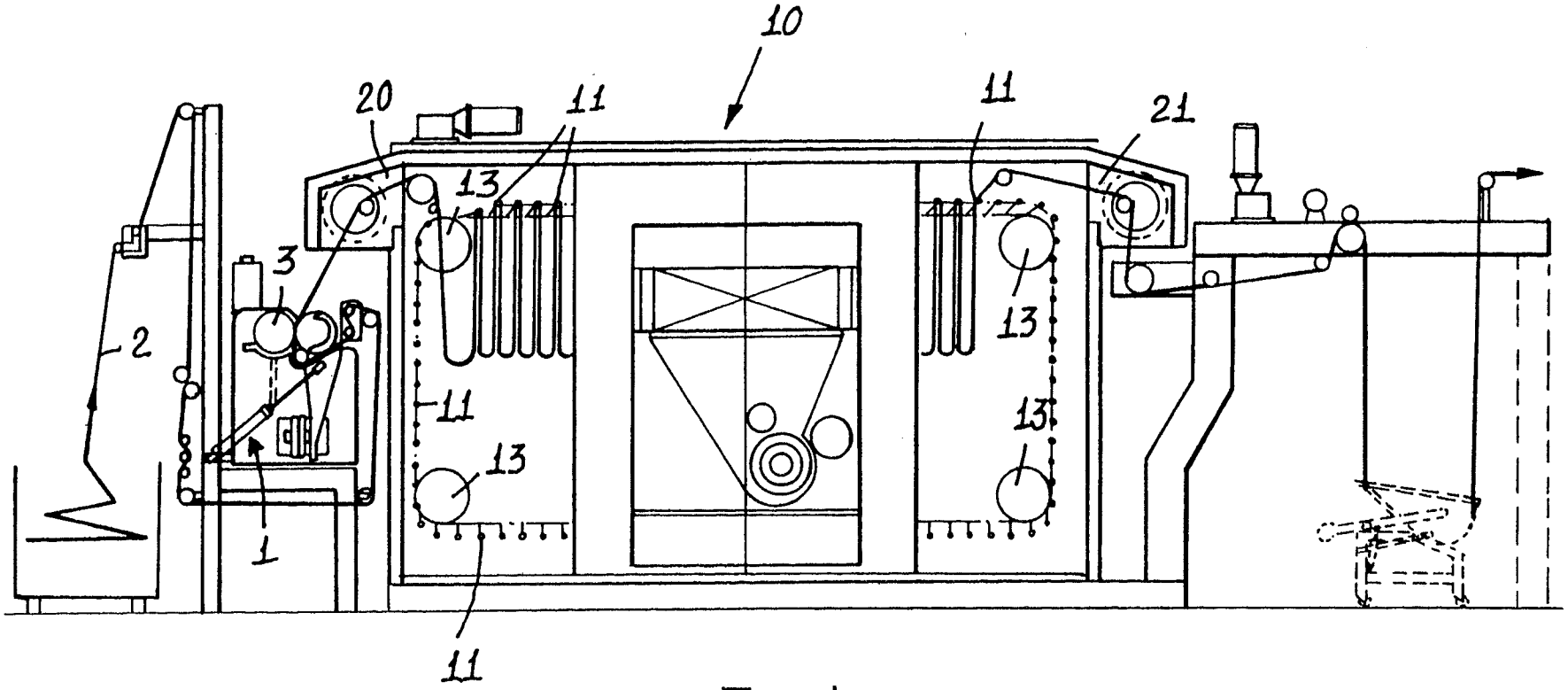
FIG. 1 is a schematic side elevation view illustrating the system used for carrying out a method according to the present invention.
Figure 2:
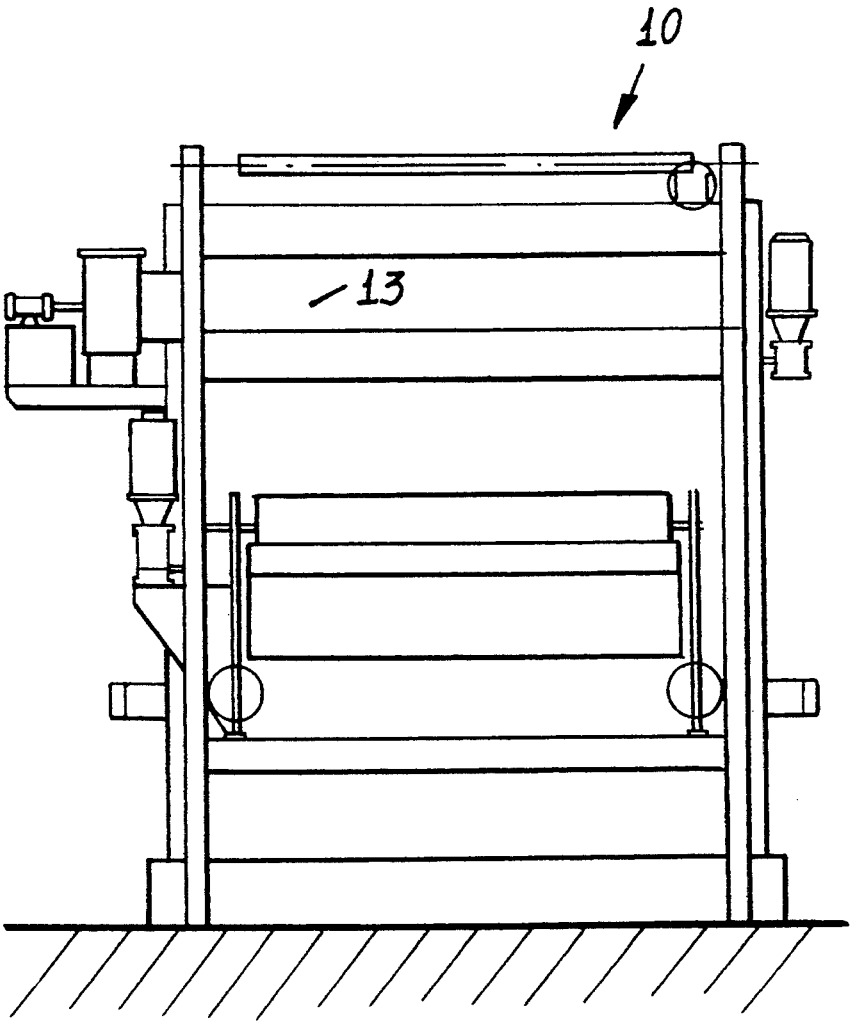
FIG. 2 is an end view of that same processing system.

With reference to the number references of the accompanying drawings, the system for setting dyes on fabrics in general, by the so-called two-step process, according to the present invention, comprises, downward of a printing and drying station in which a fabric to be processed is printed and dryed, and impregnating unit 1, for impregnating the fabric 2, which comprises a conventional foulard 3, in which there is provided a greatly alkaline chemical bath.

The fabric, impregnated by an alkali solution in the unit 1, is supplied to a vaporizer, generally indicated at the reference number 10, which is of the so-called lap type, and which comprises, in its inside, a plurality of hollow rods 11 driven by transmission and driving rollers 13 and which provide, at the top of the vaporizer, a rectilinear path between the inlet 20 and outlet 21, therethrough the supplied fabric is arranged by laps on subsequent rods 11, which rods are then caused to advance inside the vaporizer.

By arranging the fabric with a free-lap arrangement, it is possible to greatly increase the amount of fabric introduced into the vaporizer, with the consequent great advantage of remarkably increasing the holding time of the fabric inside the vaporizer, that is for a time which can vary from 90 to 120 seconds.

By increasing the processing time it is consequently possible to use steam of smaller temperature, with respect to the temperature used in a conventional column vaporizer, with a consequent increase of the moisture contents of said steam.

Thus, by increasing the fabric holding time, during the vaporizing step, it is improved the setting of the dye and, moreover, the colours have a greater intensity, owing to the provision of damper steam.

Moreover, by improving the setting and colour intensity, it is also obtained an improved penetration of the dye into the fibres of the fabric.

Thus, with the subject method, it is possible to greatly reduce the concentration of alkali substances in the setting bath, owing to the increase of the penetration time and reduction of the temperature, with a consequent great advantage from the pollution standpoint.

The thus processed fabric can be easily washed, with a reduced consume of water and cleaning materials.

Another important aspect of the method according to the invention is that, by providing a free-lap arrangement of the fabric, it is possible to apply the processing method also to jersey knitted fabrics, since between two adjoining rods there is arranged a small amount of fabric, thereby preventing the edges of the jersey knitted fabrics from rolling up, as it owwurds in conventional column system.

Moreover, owing to the increase of the fabric holding time inside the vaporizer, no pre-heating step is necessary.

From the above disclosure it should be apparent that the invention fully achieves the intended aim and objects.

In particular, the fact is pointed out that a method has been provided which, by using a "lap" vaporizer, drastically modifies the conventional two-step method for fixing dyes, while remarkably increasing or improving the characteristics of the made product.

The invention as disclosed is susceptible to several modifications and variations all of which will come within the scope of the invention.

Moreover, all of the constructional details of the system can be replaced by other technically equivalent elements.

In practicing the invention, the used materials, as well as the contingent size and shapes, can by any, according to requirements.

Moreover it should be apparent that the indicated temperature and holding time data should be considered as indicative and not limitative.

I claim:

1. A method for setting dyes on fabrics in general, by the two-step process, said method comprising, upon printing and drying a textile support, a step of impregnating said textile support with an alkali solution, characterized in that said method further comprises the step of vaporizing said impregnated textile support, by arranging said impregnated textile support with a free-lap arrangement on a plurality of supporting rods, inside a lap-processing vaporizer apparatus.

2. A method, according to claim 1, characterized in that said method comprises a step of holding said impregnated fabric in said vaporizer for a time from 90 to 120 seconds.

3. A method, according to claim 1, characterized in that said vaporizing step is carried out by using superheated steam.

4. A method, according to claim 1, characterized in that said method is a continuous type of method.

5. A system for carrying a method according to claim 1, said system comprising, downstream of a fabric printing and drying unit, an impregnating unit in which a printed and dried fabric is impregnated by chemical substances, characterized in that said system further comprises, downstream of said impregnating unit, a lap processing vaporizer for said fabric, said lap processing vaporizer including a plurality of rods movable inside said vaporizer.

* * * * *